US006158174A

United States Patent [19]

Mairs

[11] Patent Number: 6,158,174

[45] Date of Patent: Dec. 12, 2000

[54] PORTABLE NAIL CARE SYSTEM

[75] Inventor: Kimberly Mairs, Boston, Mass.

[73] Assignee: Nailport Incorporated, Boston, Mass.

[21] Appl. No.: 09/303,403

[22] Filed: May 1, 1999

[51] Int. Cl.[7] ..... E04H 1/12

[52] U.S. Cl. ..... 52/36.1; 52/36.2; 52/34

[58] Field of Search ..... 52/36.1, 36.2, 52/34, 79.1

[56] References Cited

U.S. PATENT DOCUMENTS

| | | | |
|---|---|---|---|
| 1,416,146 | 5/1922 | White | 52/34 X |
| 3,553,911 | 1/1971 | Morrow et al. | 52/36.2 X |
| 4,177,612 | 12/1979 | Tochihara | 52/36.1 X |
| 4,221,441 | 9/1980 | Bain | 52/36.2 X |
| 4,270,319 | 6/1981 | Spasojevic | 52/36.2 |
| 4,667,580 | 5/1987 | Wetzel | 52/36.2 X |
| 4,840,000 | 6/1989 | Grines | 52/36.1 |
| 5,111,626 | 5/1992 | Fortune | 52/36.2 X |
| 5,285,604 | 2/1994 | Carlin | 52/36.2 X |
| 5,967,632 | 10/1999 | Lamia | 52/36.1 X |

*Primary Examiner*—Beth A. Stephan
*Assistant Examiner*—Brian E. Glessner
*Attorney, Agent, or Firm*—Robert K. Tendler

[57] ABSTRACT

A system is provided for providing portable nail care in which a mobile nail care kiosk having running water and a station for providing the nail care is wheeled to a temporary position, such as by a gate of an airport terminal, to permit the on-the-spot provision of nail care services adjacent the gate. In one embodiment, the mobile kiosk is provided with its own self-contained water supply and waste disposal vessel, along with a heater for heating the water for a sink adjacent the nail care table for providing running water for use throughout the nail care process. By virtue of the mobility of the kiosk, nail care services can be provided at a convenient location to passengers or airport personnel whose flights have been delayed. The portable nail care service can be provided not only in airports, but also in hospitals and other locations convenient to a person requesting such services, thus to be able to provide nail care in 15 minutes or less, and permitting individuals seeking nail care to have such services provided at a location adjacent a waiting area provided for some other service such as air travel or health maintenance.

5 Claims, 3 Drawing Sheets

PORTABLE NAIL CARE SYSTEM

FIELD OF INVENTION

This invention relates to the provision of nail care services, more particularly to a portable nail care service involving the provision of a mobile kiosk having a nail care station with running water.

BACKGROUND OF THE INVENTION

The provision of nail care services to individuals in the past has required the individual to visit a nail care salon which in general is remote from the normal activity of the individual. Not only is travel time and parking a problem, with respect to the provision of nail care services, the length of time required for such services as manicures, the sculpting and painting of nails, and provision of acrylic nails, tips or fills is also a problem.

In the process, the polish that is already on the nails is removed, cuticles and nails are trimmed and filed, and new polish is applied. Additional services include hand massage and conversation.

It has been found, however, that rather than taking up to an hour for the complete process, properly trained personnel can complete the entire process in less than fifteen minutes. This is due to the provision of all materials and instruments adjacent a nail care station, along with limited conversation.

One place where quick efficient nail care services are required is at or adjacent the gates of an airport terminal. While in the past it had been thought that the amount of time necessary to be spent for nail care services precluded providing nail care services in airports, it has now been found that such services would be desirable if deliverable in a reasonably short amount of time. Due to the type of work involved, many flight attendants break nails, and the ability to have nails repaired on-the-spot has not heretofore been provided within the airport terminal or facility. Moreover, persons whose flights have been delayed would be responsive to the provision of on site nail care services if such services could be relatively quickly provided so as to prevent missing a plane. Moreover, providing nail care services adjacent the gate or other activity would give the individual the convenience of nail care, not only in a sufficiently short period of time, but in close proximity to area of other activities such as waiting to board a plane.

While nail services have in the past been provided in fixed locations where running water is not a problem, there is a need to provide nail care services adjacent locations where other normal activity is taking place. The provision of fixed location nail care services at locations removed from a gate for instance will not accommodate the public whose time constraints are short, such as at an airport terminal or in a medical care facility.

SUMMARY OF THE INVENTION

In the subject invention, nail care services are brought to an area where an individual is waiting for some other services. A mobile nail care kiosk is wheeled to the customers, in one case, to the gate at which the passengers are waiting to board a plane. Likewise, nail care services can be provided at or adjacent the bedside for patients in a medical care facility, or can be provided at or adjacent any other normal activity. The mobile nail care kiosk is provided in one embodiment with a holding tank for water and a waste tank for receiving waste water, such that running water which is a requirement for nail care and for public health purposes is provided adjacent the work station at which the nail care is provided. In one embodiment, a mobile kiosk includes a nail care station having a laterally extending flat surface, with chairs at opposite sides, and a sink at one end which is provided with the running water. Additionally, the nail care kiosk is provided with a heater so that the water provided for the nail care service provider can be warmed.

The mobile nail care kiosk is provided with wheels or runners so as to permit the positioning of the nail care kiosk adjacent a waiting area or area for other normal activity, such as the waiting area for those boarding a plane, the waiting area of an emergency room, at the bedside of a patient or indeed at any other activity in which an individual is engaged.

In summary, a system is provided for providing portable nail care in which a mobile nail care kiosk having running water and a station for providing the nail care is wheeled to a temporary position, such as by a gate of an airport terminal, to permit the on-the-spot provision of nail care services adjacent the gate. In one embodiment, the mobile kiosk is provided with its own self-contained water supply and waste disposal vessel, along with a heater for heating the water for a sink adjacent the nail care table for providing running water for use throughout the nail care process. By virtue of the mobility of the kiosk, nail care services can be provided at a convenient location to passengers or airport personnel whose flights have been delayed. The portable nail care service can be provided not only in airports, but also in hospitals and other locations convenient to a person requesting such services, thus to be able to provide nail care in 15 minutes or less, and permitting individuals seeking nail care to have such services provided at a location adjacent a waiting area provided for some other service such as air travel or health maintenance.

BRIEF DESCRIPTION OF THE DRAWINGS

These and other features of the subject invention will be better understood, in connection with the Detailed Description in conjunction with the Drawing, of which

DETAILED DESCRIPTION

Figure 1:
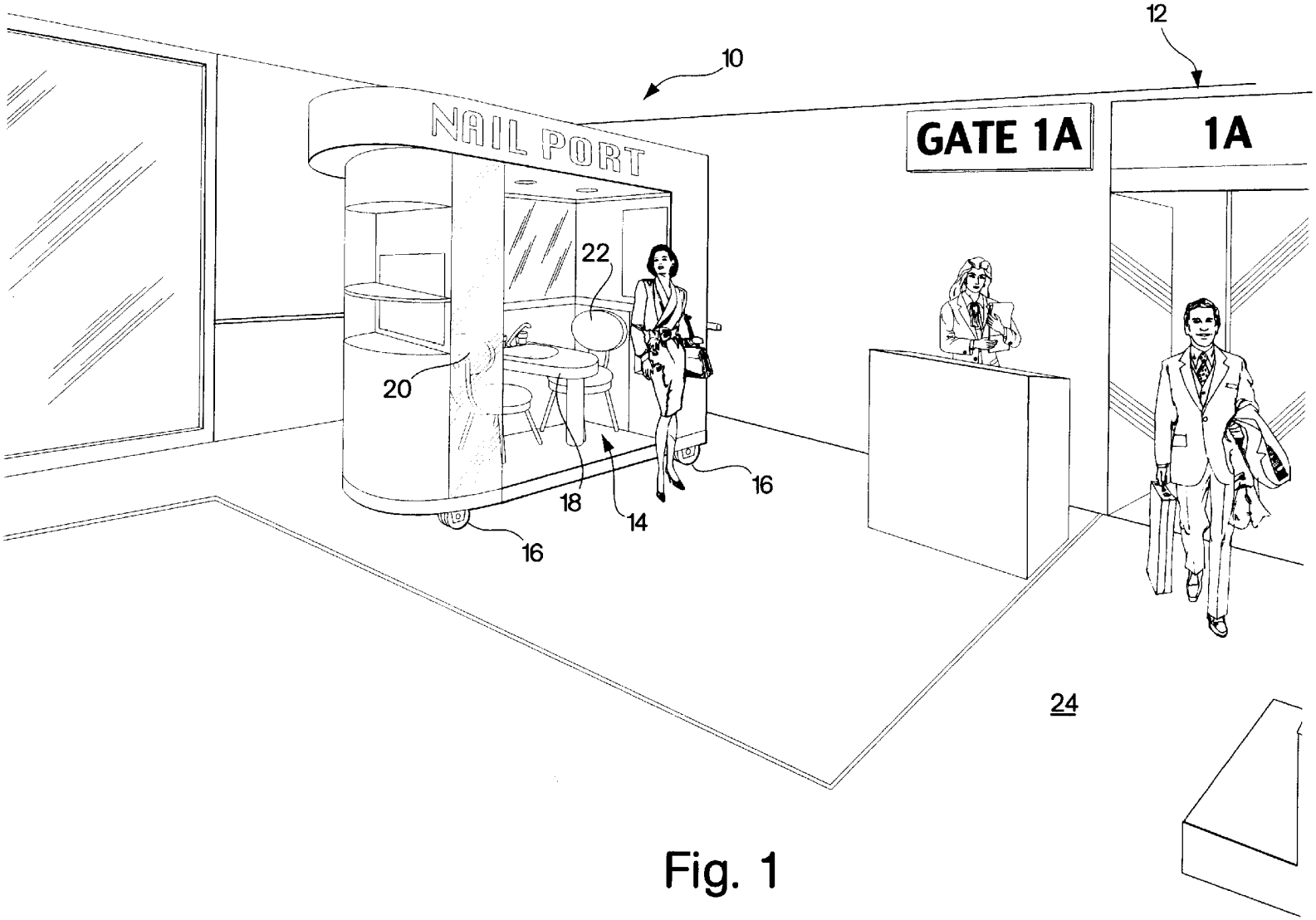
FIG. 1 is an isometric view of a portable nail port kiosk adjacent a gate in an airport terminal, illustrating the delivery of nail care services adjacent the gate.

Referring now to FIG. 1, a nail care kiosk 10 is provided adjacent a gate 12 of an airport terminal in which the kiosk is provided with wheels 14 to provide the mobility for providing the nail care services adjacent the gate 12. The kiosk in one embodiment has a nail care station 16 in which is provided a table or flat working surface 18 having opposed chairs 20, and 22.

As will be seen, kiosk 10 is adjacent an area 24 which serves some other purpose, in this case the ingress or egress of passengers through a gate. The provision of this portable kiosk at the gate area provides easy access to passengers wishing nail care services, with the mobile device providing the required running water for the provision of such services.

As mentioned hereinbefore, it has been found that nail care services can be provided in as little as 10–15 minutes, with the adjacency of the kiosk to the gate permitting the services to be provided in a timely fashion so that passengers can catch their flights and make their connections.

Figure 2:
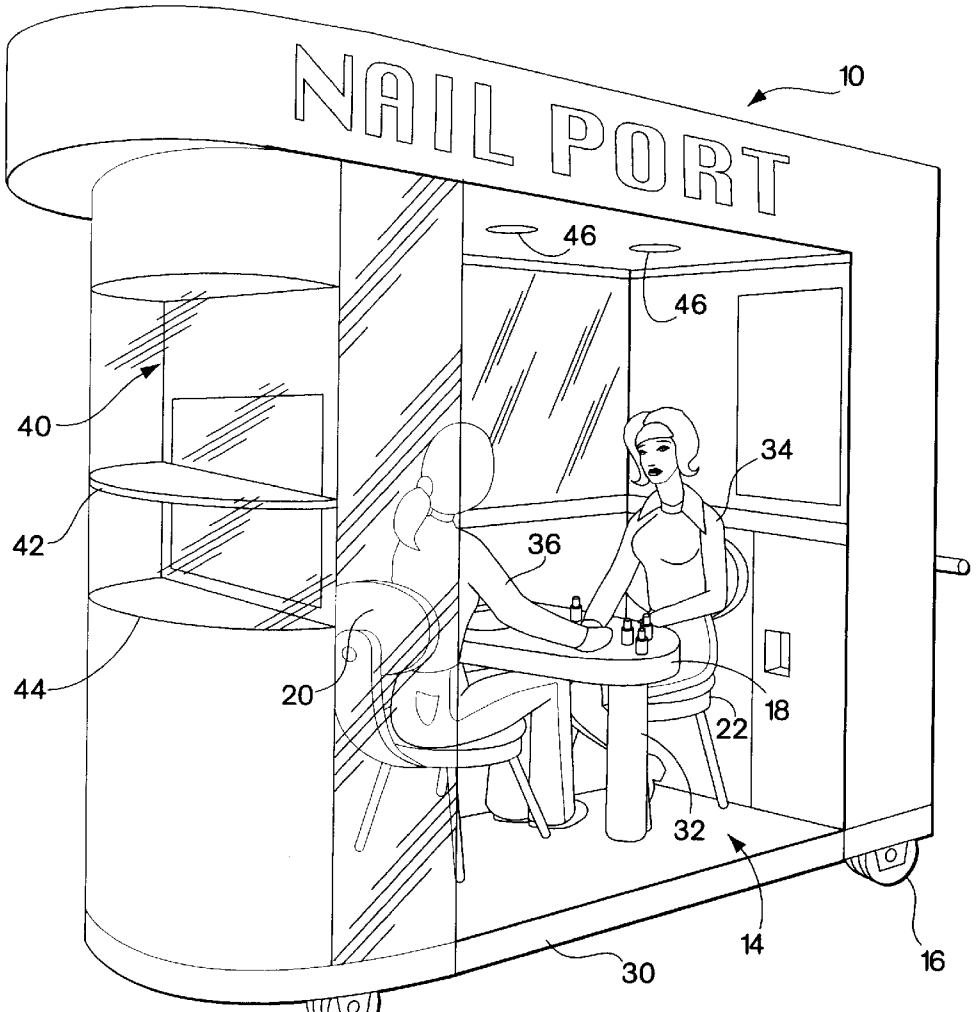
FIG. 2 is a diagrammatic illustration of the portable nail care kiosk of FIG. 1, showing the provision of nail care services at a station having running water in which the kiosk is provided with wheels for mobility and a station including a flat working surface at which the nail care services are provided

Referring to FIG. 2, kiosk 10 is shown as having a floor or base portion 30 to which casters or wheels 16 are attached. Base 30 is provided with a pedestal 32, accommodating a flat working surface 18 at which the nail care services are administered by a manicurist or a nail care specialist 34 sitting on chair 22.

The individual receiving nail care, here illustrated at 36, is seated in chair 20 opposite the nail care specialist. The nail care specialist is instructed to keep conversation to a minimum so that the nail care services can be provided in a time sufficiently short so as not to interfere with the individual's other activities.

In the illustrated embodiment, kiosk 10 is provided with a display case 40, having shelves 42, and 44 for the provision of and/or sale of nail care products, with suitable lighting for the work station being provided by lamps 46, so as to give adequate lighting to the nail care specialist providing the services.

Figure 3:
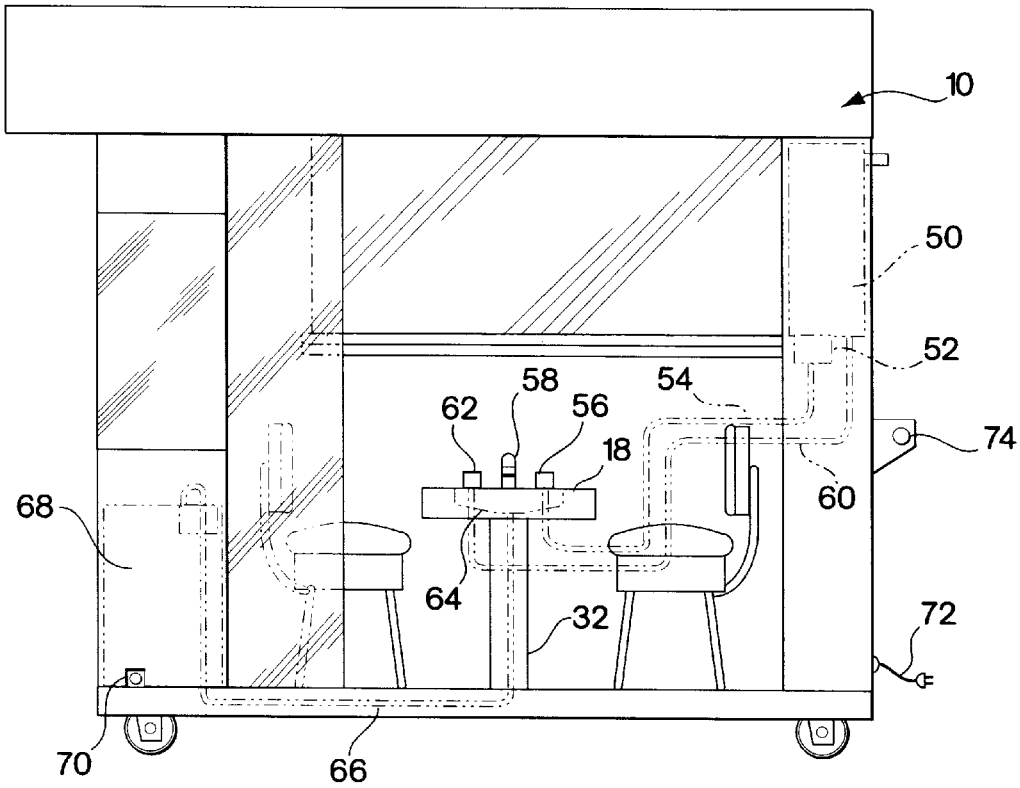
FIG. 3 is a side view of a portable nail care kiosk station, illustrating the provision of a station at which opposed seats are provided, and in which a sink is provided at the station imbedded in the nail care working surface in which hot and cold running water is provided by internally carried containers or vessels within the kiosk, in which waste water is collected in a waste container or vessel.

Referring now to FIG. 3, it can be seen that kiosk 10 is provided with a fresh water holding container or vessel 50, with a heater 52 being provided at the base of the container or vessel. Heated water over a conduit, here illustrated by dotted line 54, is provided to a faucet 56, which controls the flow of hot water faucet 58. Cold water from vessel 50 is provided over a conduit, here illustrated by dotted line 60, to a faucet valve 62 for providing cold water to a basin, here illustrated by dotted line 64, the outlet of which is provided over conduit, here illustrated by dotted line 66, to a waste container or vessel 68, also located within kiosk 10. Vessel 68 is provided with an outlet 70 for flushing waste water, whereas the kiosk is powered by an electrical power cord 72, which powers heater 52 and lamps 46, thereby to provide a complete self-contained mobile nail care facility.

Figure 4:
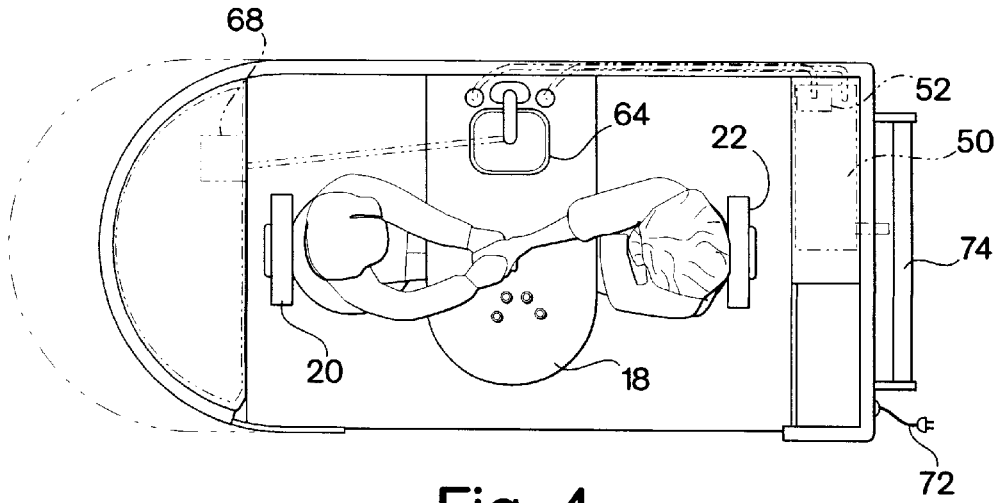
FIG. 4 is a top diagram of the portable nail care kiosk of FIG. 3, showing the opposed chairs and sink for providing the running water.

Referring now to FIG. 4, it will be appreciated that sink 64 is undersized so as to provide maximum area for nail care services on working surface 18, thereby providing a compact mobile nail care facility. It will be appreciated that the kiosk in one embodiment can be provided with a handlebar 74, which is useful in moving the mobile nail care kiosk from one location to another adjacent an appropriate area.

While the subject invention has been described in terms of providing portable nail care through the utilization of a single station kiosk it will be appreciated that multiple station kiosks are within the scope of subject invention.

It will also be appreciated that while the subject nail care system has been shown provided adjacent a gate at an airport terminal, the mobile unit can be rolled into any area where the convenience of the person requiring nail care is required.

In summary, it is the purpose of the subject portable nail care system to provide extremely rapid nail care services due to the proximity of the mobile kiosk, with respect to a waiting area or an area of normal activity for the customer. It is also a feature of the subject invention that the portable nail care facility is provided with running hot and cold water and waste tank for the return from the sink utilized.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. A system for delivering nail care so as to minimize the time a customer has to spend receiving the service, comprising:

a portable kiosk having a nail care station including a work station having a flat surface and a sink therein opened to the top of the flat surface of said work station, said sink having a faucet and a drain, and further including a pair of opposed chairs positioned to either side of said work station with at least a portion of the seats thereof positioned under said work station such that a person seated on a chair faces the work station at a position to present the person's hands to meet those of a person seated on the other chair;

a source of running water carried by said kiosk;

a conduit for connecting said source of running water to said faucet;

a waste container carried by said kiosk; and a conduit connecting said drain and said waste water container, whereby a portable self contained care kiosk can be provided adjacent an area normally used by said customer so as to locate nail care services in the immediate proximity of said customer, thus bringing nail care services to said customer.

2. The system of claim 1, and further including a heater carried by said kiosk and connected to said running water source for heating the water therefrom.

3. The system of claim 1, wherein said kiosk includes wheels attached to the bottom thereof to give mobility so said kiosk.

4. The system of claim 1, and further including seating in said kiosk for said customer and the person providing the nail care services.

5. A method for delivering nail care so as to minimize the time a customer has to spend receiving the service, comprising the steps of:

providing a portable kiosk having a nail care station including a work station having a flat surface and a sink therein opened to the flat top surface of the work station, the sink having a faucet and a drain, a source of running water carried by the kiosk, a conduit for connecting the source of running water to the faucet, a waste water container carried by the kiosk, a conduit connecting the drain and the waste water container, and a pair of opposed chairs to either side of the work station to permit a manicure to be performed, with at least a portion of the seats of the chairs adapted to extend under the work station to permit the hands of the individuals seated in the opposed chairs to meet to permit providing nail care;

providing the kiosk with wheels; and, locating the kiosk in the immediate vicinity of a customer, whereby a portable self contained nail care center can be provided adjacent an area normally used by said customer so as to locate nail care services in the immediate proximity of the customers thus bringing the nail care services to the customer.

* * * * *